US005848821A

United States Patent [19]

Kirby

[11] Patent Number: 5,848,821

[45] Date of Patent: Dec. 15, 1998

[54] DOUBLE RECLINER

[75] Inventor: Steven M. Kirby, Lenoir City, Tenn.

[73] Assignee: Kirby Furniture Mfg., Lenoir City, Tenn.

[21] Appl. No.: 851,930

[22] Filed: May 6, 1997

[51] Int. Cl.[6] ..... A47C 1/02

[52] U.S. Cl. ..... 297/232; 297/248; 248/346.01

[58] Field of Search ..... 297/232, 248, 297/217.7, 346.01, 188.1

[56] References Cited

U.S. PATENT DOCUMENTS

| | | | |
|---|---|---|---|
| 1,658,456 | 2/1928 | Meyer | 248/346.01 |
| 2,204,212 | 6/1940 | Geugh | 248/188.1 X |
| 3,713,620 | 1/1973 | Tkach | 248/346.01 X |
| 4,409,762 | 10/1983 | Raymond | 297/248 X |
| 4,740,031 | 4/1988 | Rogers, Jr. | 297/232 X |
| 5,000,512 | 3/1991 | Laird | 297/232 X |
| 5,064,244 | 11/1991 | Sproule | 297/68 |
| 5,106,153 | 4/1992 | Durling | 297/232 |
| 5,234,253 | 8/1993 | La Point et al. | 297/248 |
| 5,314,234 | 5/1994 | England | 297/248 |
| 5,474,359 | 12/1995 | Muffi | 297/232 X |
| 5,480,213 | 1/1996 | Sproule | 297/232 |
| 5,520,437 | 5/1996 | La Point et al. | 297/248 X |
| 5,535,975 | 7/1996 | Scott | 248/346.01 |
| 5,564,781 | 10/1996 | Pine | 248/346.01 X |
| 5,630,644 | 5/1997 | La Point et al. | 297/248 X |

OTHER PUBLICATIONS

The Gentry Gallery, Inc. v. The Berkline Corporation, U.S. District Court for the District of Massachusetts, Civil Action No. 91–13292–MAP, *Memorandum Re: Remaining Issue,* Sep. 30, 1996.

*Primary Examiner*—Jose V. Chen
*Assistant Examiner*—Rodney B. White
*Attorney, Agent, or Firm*—Pitts & Brittian, P.C.

[57] ABSTRACT

An improved double recliner having a load distributing platform base member. The planar load distributing platform prevents the individual components from torquing in relation to one another as one end of the double recliner is lifted by providing single unitary load distributing base for the individual components. The improved double recliner has two recliner rockers with a centrally disposed console placed between the two recliner rockers. The planar platform carries recliner bases that are secured to the platform in selected positions and the recliners are mounted upon, and secured to, the recliner bases thus forming a single unit of furniture.

13 Claims, 6 Drawing Sheets

DOUBLE RECLINER

TECHNICAL FIELD

This invention relates to recliners. More particularly, it relates to an improved double recliner having a load distributing platform.

BACKGROUND ART

For many people, it has become quite popular to enjoy television, home movies and companionship from the comforts of a large, well padded chair that includes a mechanism for allowing the chair to tilt back, i.e. a recliner. Long considered the quintessential "father's chair", the recliner has become every person's chair. It is now common for furniture arrangements to include more than one recliner. However, among some, a multitude of recliner's in a single room is unaesthetic. To overcome this, furniture designers have incorporated the recliner concept into at least four types of furniture, namely, free standing sofas with recliners at each end (so called "double reclining" stand alone sofas), one armed recliners that could abut a table, airplane-type side-by-side recliners separated by a seat with a drop-down tray, and armless recliners. Moreover, the recliner has also been integrated into the so-called sectional sofa. Typically, a sectional sofa consists of several components organized into an "L" shape with a wedge, such as a table or chair section, at the junction. In this regard, it is not uncommon for a sectional sofa to include a single recliner, or a recliner at opposite ends of the "L". Sproule, with U.S. Pat. Nos. 5,064,244 and 5,480,213, advanced the art of incorporating a recliner in a sectional sofa by inventing a reclining sofa that incorporated two, side-by-side recliners, one of which was "armless" since it abutted an additional component of the sectional sofa.

The present invention is primarily directed to the double reclining stand alone sofa, such as is disclosed in U.S. Pat. No. 5,106,153 which issued to Durling on Apr. 21, 1992. This furniture design typically includes two recliners, often separated by a console that may, or may not, include a storage bin. Typically, the three components are connected by means of a rail frame so as to form a single unit of furniture. While this rail frame provides adequate support for the console and recliners and joins them together as a single unit of furniture, a problem arises when there is a need to lift and move the double recliner. Namely, when one end of the double recliner is lifted, care must be devoted to ensure that the individual components do not torque in relation to one another particularly if the corner of the double recliner is the point being lifted. The resultant torqueing has the potential of breaking the rails of the frame and causing the individual components to become disengaged severely damaging the double recliner, and potentially resulting in the destruction of the piece of furniture.

What has been needed in the art is a double recliner that is constructed with a load distributing platform so as to prevent the individual components from torquing in relation to one another as one end of the double recliner is lifted.

It is accordingly an object of the present invention to provide a double recliner that is constructed with a load distributing platform to which the components are secured thus forming a single unit of furniture.

It is a further object of the present invention to provide a double recliner in which the load distributing platform provides a common base for the components and prevents the individual components from torquing in relation to one another as one end of the double recliner is lifted.

Still another object of the present invention is to provide an improved double recliner in which the platform distributes the load thus reducing the pressure exerted on a floor by the double recliner.

Other objects and advantages over the prior art will become apparent to those skilled in the art upon reading the detailed description together with the drawings as described as follows.

DISCLOSURE OF THE INVENTION

In accordance with the various features of this invention, an improved double recliner is provided. The double recliner has two recliner rockers with a centrally disposed console placed between the two recliner rockers. Each component is carried by a single unitary load distributing platform. The platform is a planar rigid member having a substantially rectangular surface area. Preferably, the platform is constructed of particle board, but can also be constructed of plywood, solid wood or some other similarly rigid composite. In this regard, rocker bases are secured to the platform in selected positions and the recliners are mounted upon, and secured to, the rocker bases.

BEST MODE FOR CARRYING OUT THE INVENTION

Figure 1:
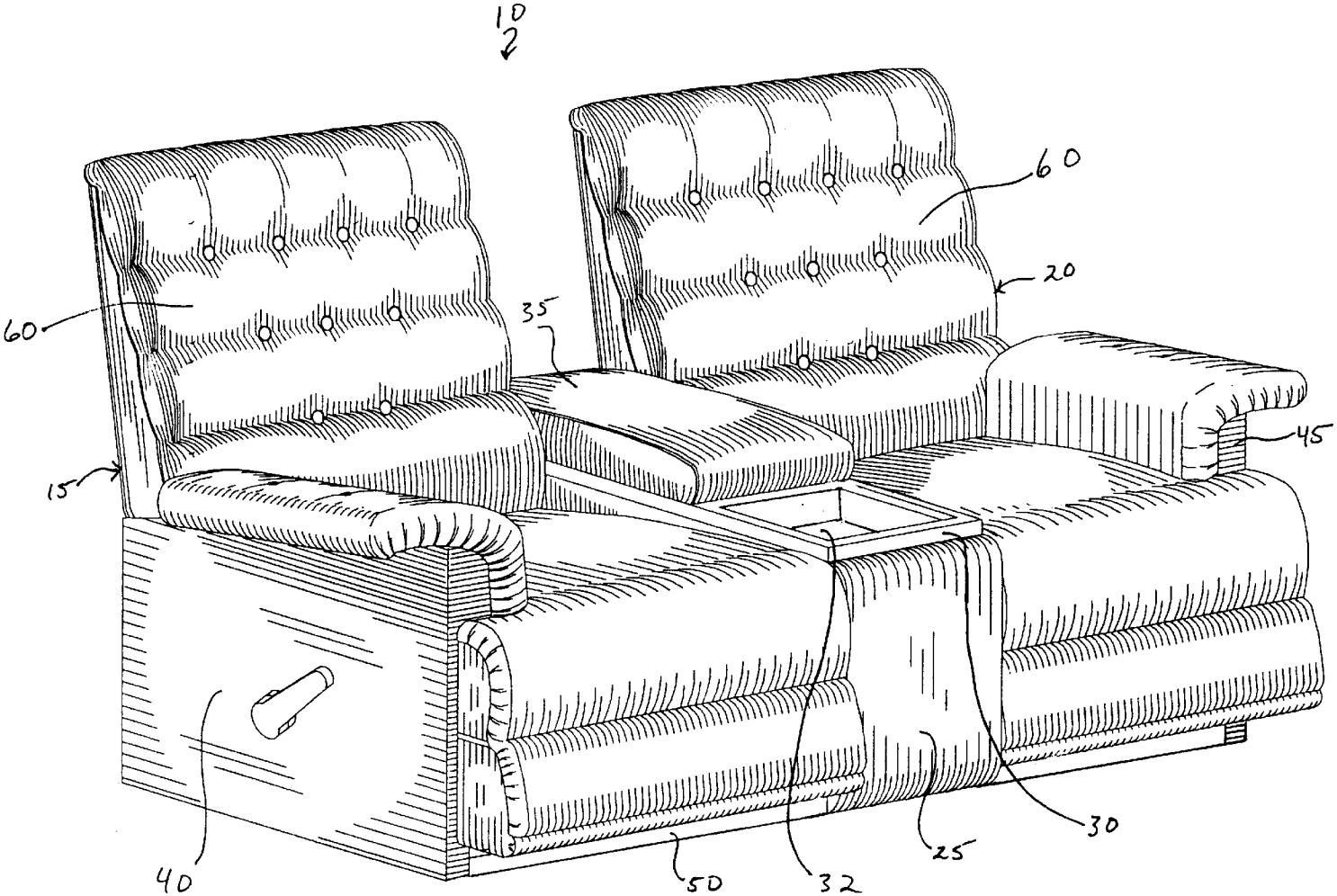
FIG. 1 is a perspective view of the present invention.

An improved double recliner constructed in accordance with the present invention is illustrated generally as 10 in the figures. Improved double recliner 10 includes a right chair member 15 and a left chair member 20. While the present invention is equally suitable for a stand alone double rocker, in the preferred embodiment, right and left chair members 15 and 20 are each provided with mechanisms (not shown) to allow the chair members 15 and 20 to recline. A pedestal 25 is disposed between chair member 15 and chair member 20. A console 30 is carried by pedestal 25 and may include a storage bin 32 which may be concealed by a table top, (not shown). Additionally, center armrest 35 is carried by pedestal 25 proximate console 30. Right chair member 15 includes right armrest 40 and left chair member 20 includes left armrest 45. Chair members 15 and 20 and pedestal 25 are each secured to platform 50 so as to provide a single unit of furniture.

Figure 5:
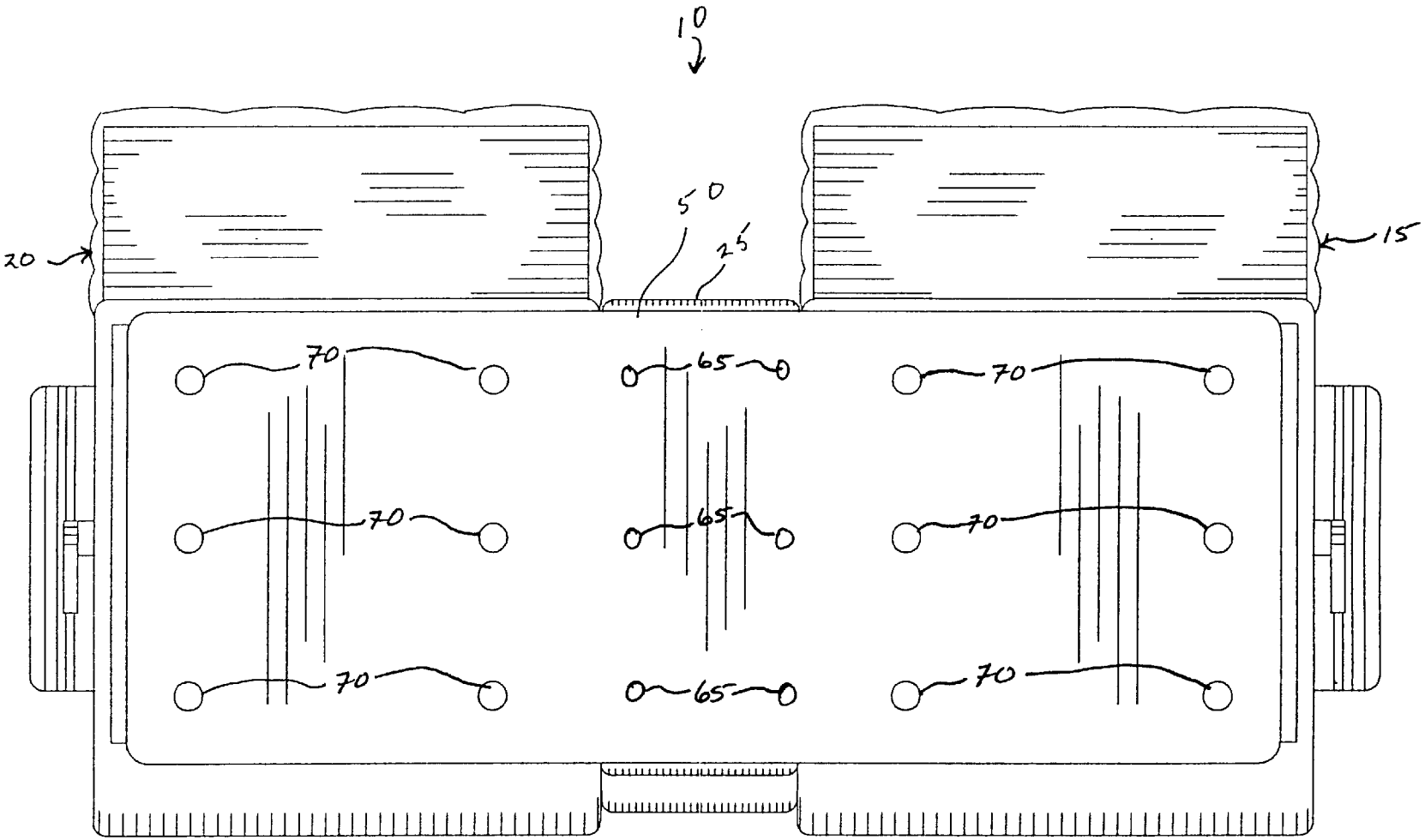
FIG. 5 is a bottom plan view of the recliner shown in FIG. 1.
Figure 6:
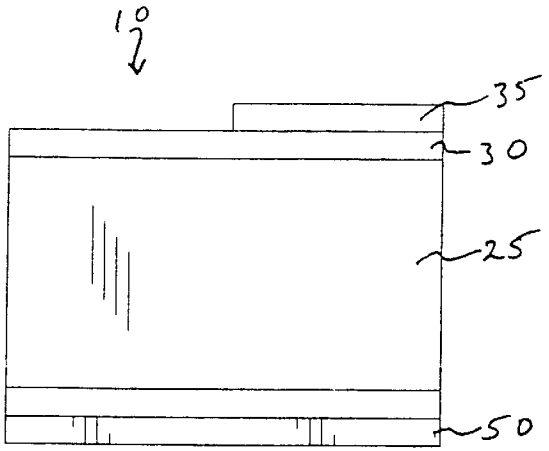
FIG. 6 is a left side view of the platform and pedestal shown in FIG. 4.

Platform 50 is a rigid planar member having a substantially rectangular top surface area. As seen in FIG. 5, platform 50 has, preferably, a smaller "footprint" than improved double recliner 10. For example, in one embodiment, in which the dimensions of improved double recliner 10 are 40" deep by 72" wide, platform 50 is preferably approximately 23" deep by approximately 60" wide. In the preferred embodiment, platform 50 is constructed of plywood. However, those skilled in the art will recognize that platform 50 could be constructed of press board, particle board, solid wood, a polymer, a composite or any similarly rigid material.

Figure 2:
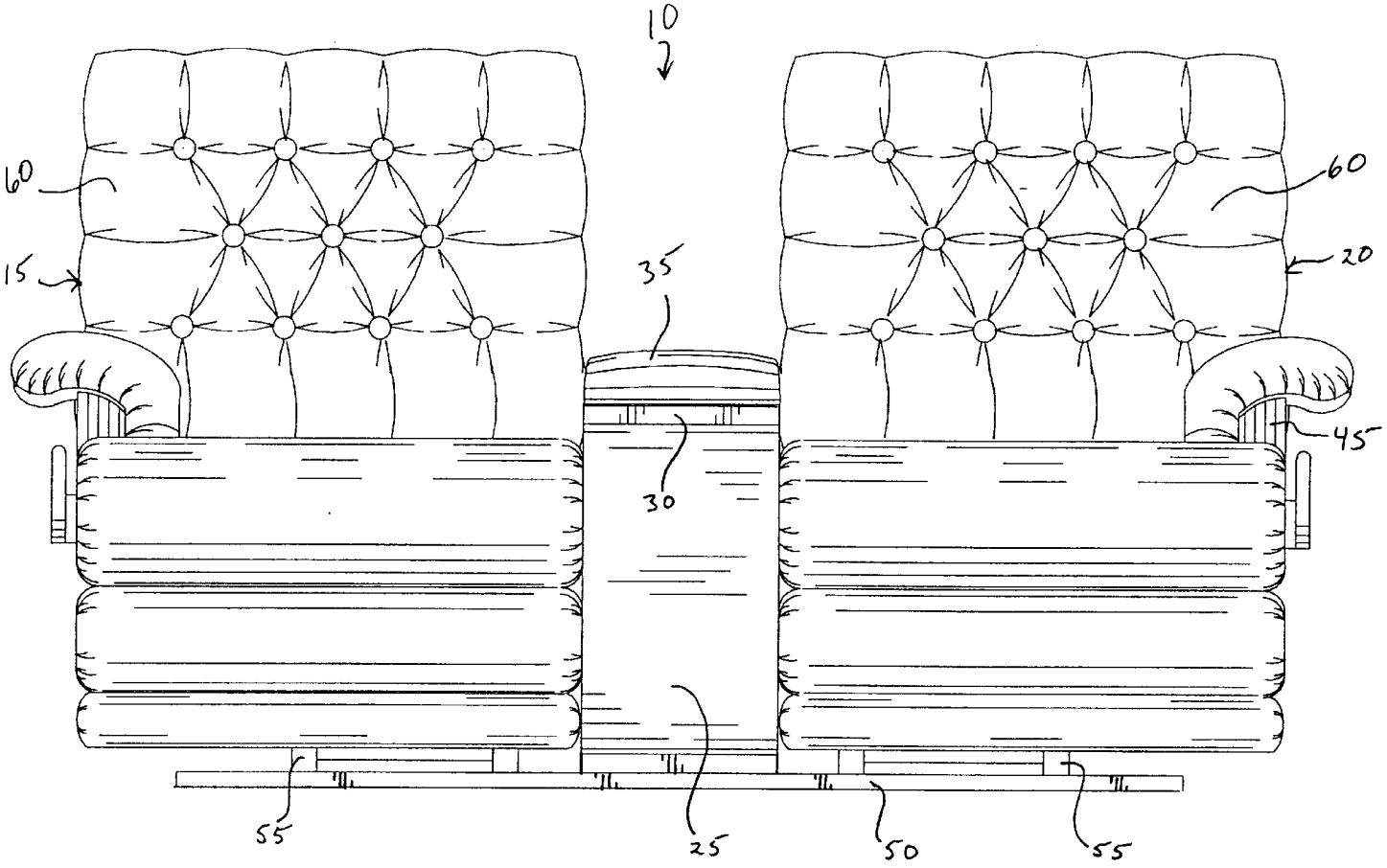
FIG. 2 is a front view of the recliner shown in FIG. 1.
Figure 3:
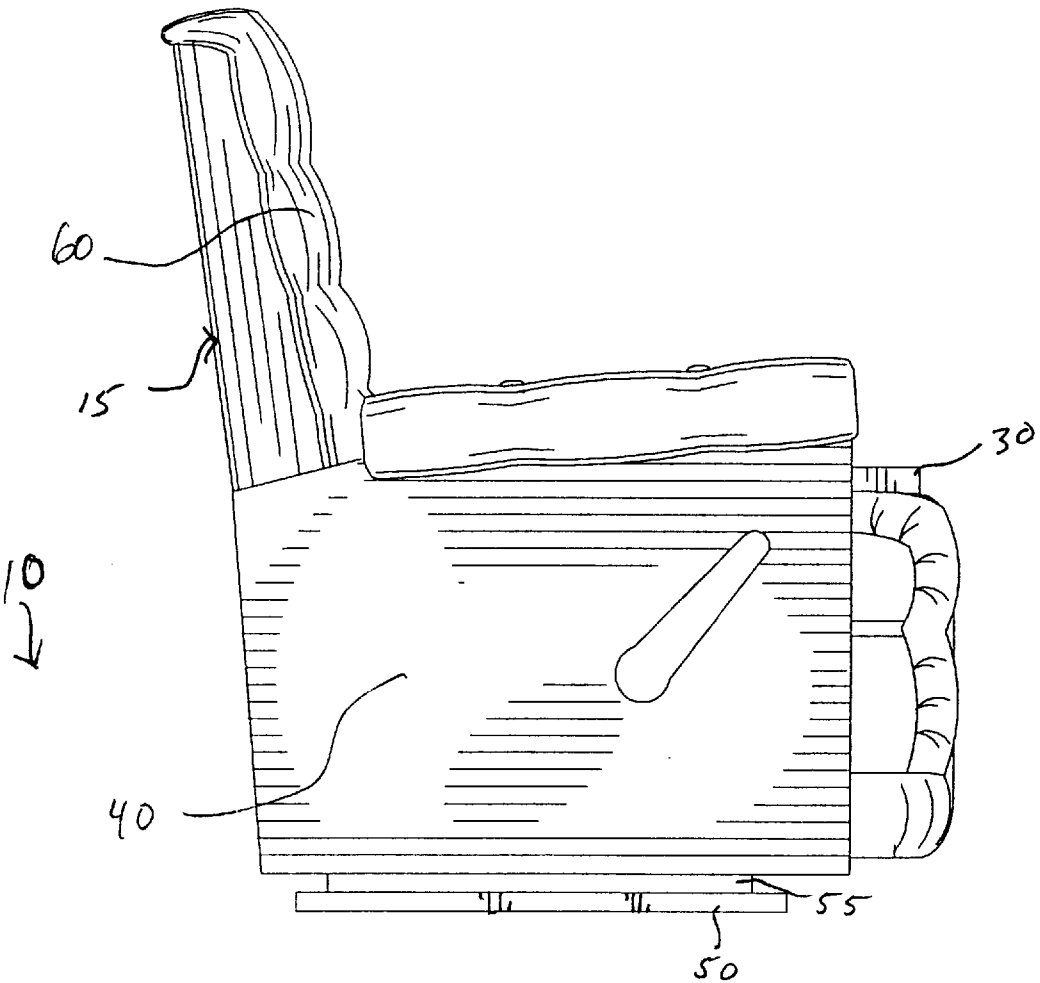
FIG. 3 is a right side view of the recliner of FIG. 1.
Figure 4:
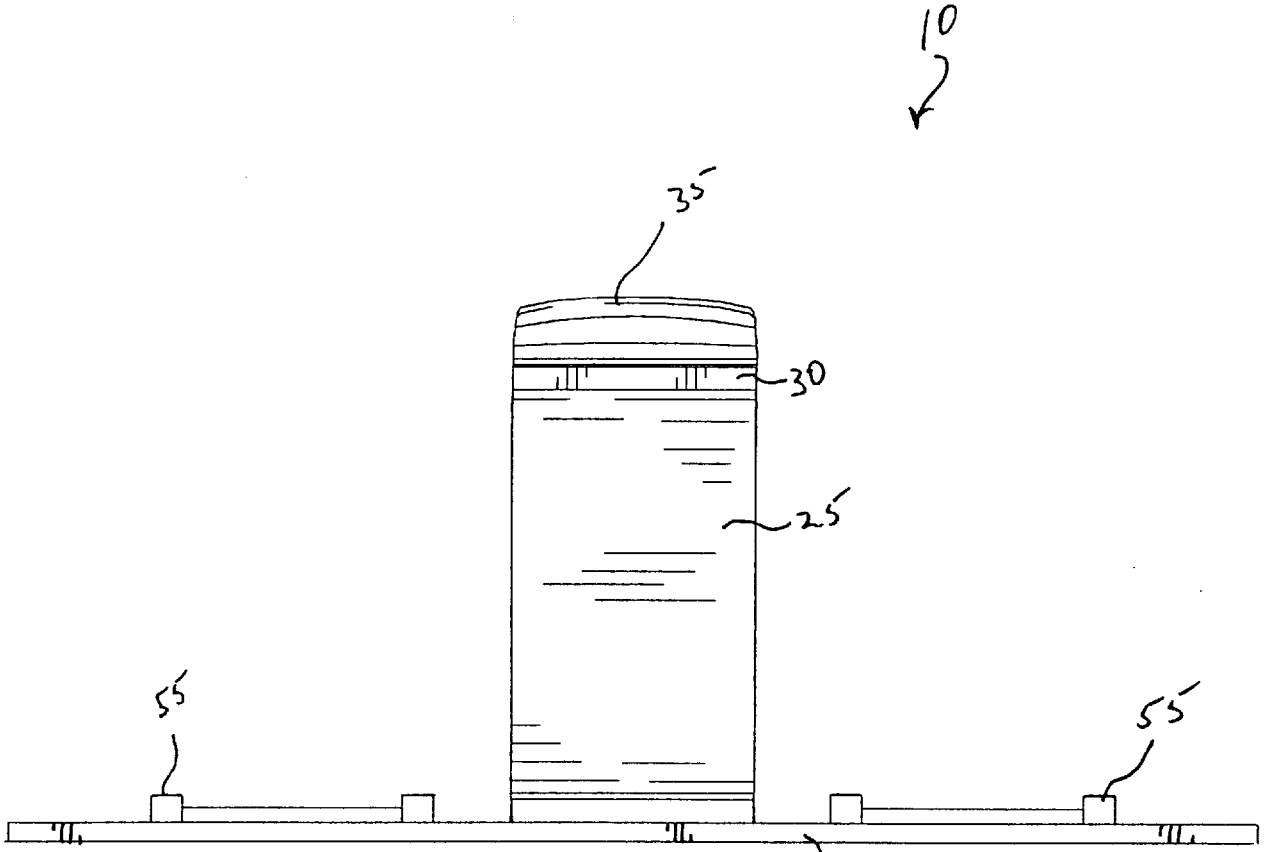
FIG. 4 is a front view of the platform and pedestal of the present invention.
Figure 7:
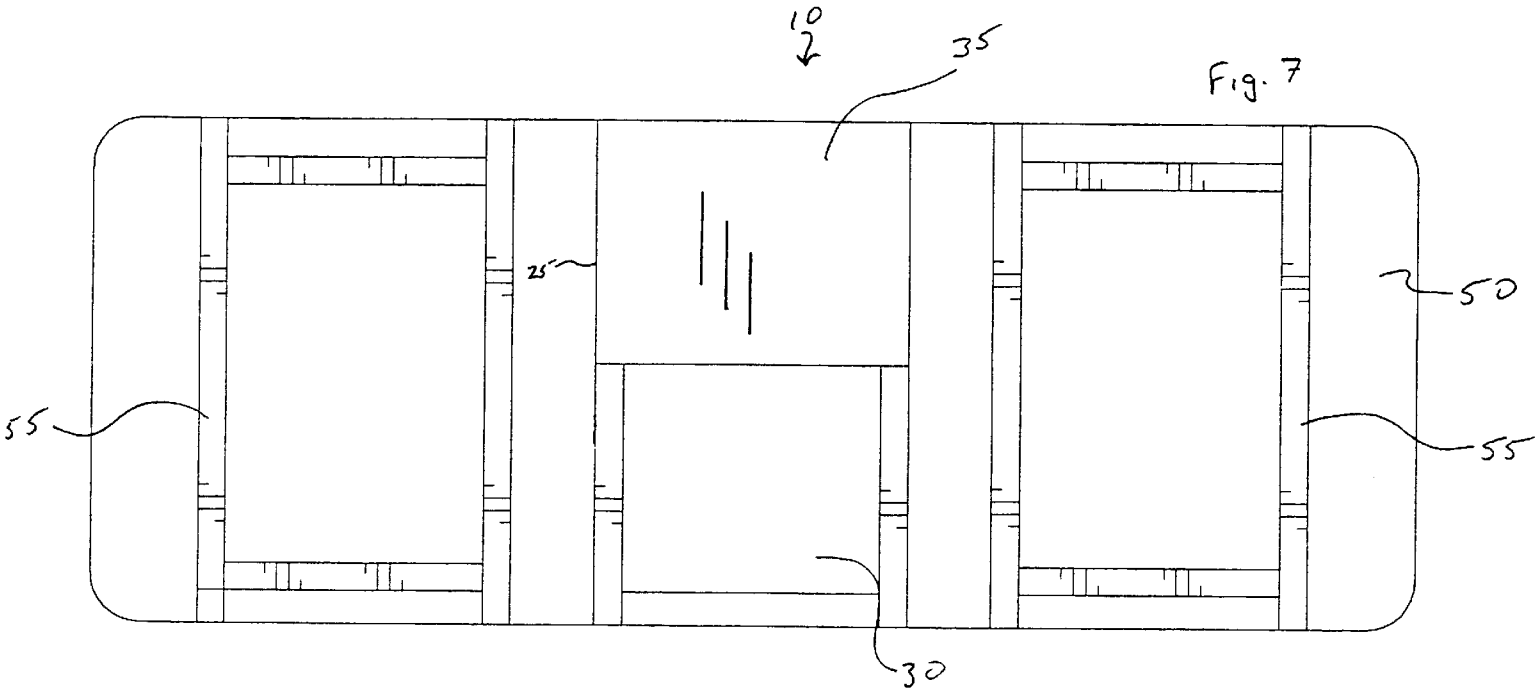
FIG. 7 a top plan view of the platform and pedestal shown in FIG. 4.

As seen in FIGS. 2, 4 and 7, in the preferred embodiment, pedestal 25 is fixed directly to the central portion of platform 50 by means of fasteners 65, as shown in FIG. 5 which preferably are threaded metal fasteners. Further, recliner base members 55 are secured to platform 50, one on either side of pedestal 25 proximate the ends of platform 50 by means of fasteners 70 which, likewise, are preferably threaded metal fasteners. It will be recognized by those skilled in the art that an adhesive glue or epoxy can be used in addition to using fasteners 65 and 70 to secure pedestal 25 and recliner base members 55, respectively, to platform 50.

In the preferred embodiment, each respective chair member is provided with a padded seat back 60 and is otherwise upholstered in a conventional manner. Likewise, the reclining mechanism (not shown) is also a conventional mechanism.

From the foregoing description, it will be recognized by those skilled in the art that an improved double recliner offering advantages over the prior art has been provided. Specifically, the improved double recliner provides a double recliner that is constructed so as to prevent the individual components from torquing in relation to one another as one end of the double recliner is lifted. This is achieved by providing a load distributing platform that provides a common base for the components. Finally, the present invention provides an improved double rocker in which the platform has a large surface area that distributes the load, thus reducing the pressure exerted on a floor by the improved double rocker.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention,

I claim:

1. An improved double recliner having a load distributing planar platform, said improved double recliner comprising:

a rigid planar platform member having a substantially rectangular surface area;

a pedestal member secured to said rigid planar platform member and centrally disposed on said rigid planar platform member;

a pair of chair base members secured to said rigid planar platform member, wherein said pedestal member is disposed between said pair of chair base members; and a chair member secured to each of said pair of chair base member whereby said rigid planar platform member joins said pedestal member and said chair members into a single unit of furniture whereby said rigid planar platform member provides a common base for said pedestal member and each of said chair members so as to prevent said pedestal member and said chair members from torquing in relation to one another as said double recliner is lifted.

2. The improved double recliner of claim 1 wherein said chair members are reclining chair members.

3. The improved double recliner of claim 1 wherein a console having a storage bin is carried by said pedestal member.

4. The improved double recliner of claim 3 wherein a center armrest is carried by said pedestal member proximate said console.

5. The improved double recliner of claim 1 wherein said rigid planar platform member is constructed of plywood.

6. The improved double recliner of claim 1 wherein said improved double recliner is dimensioned so as to define a first footprint having a first selected depth and a first selected width and further wherein said rigid planar platform member is dimensioned so as to define a second footprint having a second selected depth and a second selected width, wherein said first selected depth is greater than said second selected depth and said first selected width is greater than said second selected width.

7. An improved double recliner having a load distributing planar platform, said improved double recliner comprising:

a rigid planar platform member having a substantially rectangular surface area;

a pedestal member secured to said platform member and centrally disposed on said platform member;

a pair of recliner base members secured to said platform, wherein said pedestal member is disposed between said recliner base members; and a reclining chair member secured to each of said plurality of recliner base members whereby said platform member joins said pedestal member and said chair members into a single unit of furniture whereby said rigid planar platform member provides a common base for said pedestal member and each of said reclining chair members so as to prevent said pedestal member and said reclining chair members from torquing in relation to one another as said double recliner is lifted.

8. The improved double recliner of claim 7 wherein a console having a storage bin and a center armrest proximate said console are carried by said pedestal member.

9. The improved double recliner of claim 7 wherein said rigid planar platform member is constructed of plywood.

10. The improved double recliner of claim 7 wherein said improved double recliner is dimensioned so as to define a first footprint having a first selected depth and a first selected width and further wherein said rigid planar platform member is dimensioned so as to define a second footprint having a second selected depth and a second selected width, wherein said first selected depth is greater than said second selected depth and said first selected width is greater than said second selected width.

11. An improved double recliner having a load distributing planar platform, said improved double recliner comprising:

a rigid planar platform member having a substantially rectangular surface area, wherein said improved double recliner is dimensioned so as to define a first footprint having a first selected depth and a first selected width and further wherein said rigid planar member is dimensioned so as to define a second footprint having a second selected depth and a second selected width, wherein said first selected depth is greater than said second selected depth and said first selected width is greater than said second selected width;

a pedestal member secured to said platform member and centrally disposed on said platform member;

a pair of recliner base members secured to said platform, wherein said pedestal member is disposed between said recliner base members; and a reclining chair member secured to each of said plurality of recliner base member whereby said platform member joins said pedestal member and said chair members into a single unit of furniture whereby said rigid planar platform member provides a common base for said pedestal member and each of said reclining chair members so as to prevent said pedestal member and said reclining chair members from torquing in relation to one another as said double recliner is lifted.

12. The improved double recliner of claim 11 wherein a console having a storage bin and a center armrest proximate said console are carried by said pedestal member.

13. The improved double recliner of claim 11 wherein said rigid planar platform member is constructed of plywood.

* * * * *